United States Patent [19]

Greco, Jr. Robert L.

[11] Patent Number: 5,022,640

[45] Date of Patent: Jun. 11, 1991

[54] AUTO-DUPLEX/SIMPLEX FEEDER MODULE

[75] Inventor: Robert L. Greco, Jr., Penfield, N.Y.

[73] Assignee: Xerox Corporation, Stamford, Conn.

[21] Appl. No.: 791,807

[22] Filed: Oct. 28, 1985

[51] Int. Cl.[5] ..... B65H 5/22

[52] U.S. Cl. ..... 271/31; 271/21; 271/117; 271/291; 271/188; 271/208; 271/221; 355/319

[58] Field of Search ..... 271/3.1, 4, 9, 6, 12, 271/21, 221, 244, 245, 246, 271, 118, 117, 277, 275, 82, 65, 291, 902, 301, 163, 186, 188, 208, 35, 34, 126, 160; 270/58; 355/308, 309, 317-320

[56] References Cited

U.S. PATENT DOCUMENTS

| | | | |
|---|---|---|---|
| 3,550,935 | 12/1970 | Smith et al. | 271/188 |
| 4,084,805 | 4/1978 | Simpson | 271/181 X |
| 4,110,030 | 8/1978 | Knechtel | 271/65 X |
| 4,184,671 | 1/1980 | Sasamori | 271/35 X |
| 4,200,386 | 4/1980 | Queener | 271/291 X |
| 4,214,740 | 7/1980 | Acquaviva | 271/188 X |
| 4,272,180 | 6/1981 | Satomi et al. | 271/3.1 X |
| 4,279,504 | 7/1981 | Brown et al. | 271/3.1 X |
| 4,285,607 | 8/1981 | Steinhilber | 400/652 |
| 4,330,197 | 5/1982 | Smith et al. | 271/3.1 X |
| 4,363,477 | 12/1982 | Miyashita | 271/127 X |
| 4,456,237 | 6/1984 | Buddendeck | 271/291 X |
| 4,469,319 | 9/1984 | Robb et al. | 271/3.1 |
| 4,489,931 | 12/1984 | Costa et al. | 271/277 |
| 4,506,881 | 3/1985 | Hunt et al. | 271/3.1 X |
| 4,512,651 | 4/1985 | Dunleavy, Jr. | 271/3.1 X |
| 4,579,327 | 4/1986 | Furuichi | 271/3.1 |

OTHER PUBLICATIONS

Bishop et al., "Duplex Copier"(Sep., 1979), IBM Tech. Discl. Bulletin, vol. 22, No. 4, pp. 1377-1378.

Schell, "Static Charge Elimination in the Semiautomatic Document Feed of a Copier", IBM Tech. Discl. Bul., vol. 22, No. 3, p. 912 (Aug. 79).

Roller, D. C., "Recirculating Automatic Document Feeder", IBM Tech. Discl. Bulletin, vol. 22, No. 6, p. 2228 (Nov., 1979).

*Primary Examiner*—Kevin P. Shaver

*Attorney, Agent, or Firm*—William A. Henry, II

[57] ABSTRACT

A self-contained duplex/simplex feeder module adapted to be used for both top and bottom sheet feeding for simplex and duplex copying includes a pair of feed-in rolls with one of the rolls serving as a feed-out roll when top sheet feeding is required. A static eliminator is also included to enhance the feeding of sheets for duplexing as is a false bottom used for top sheet feeding and normal force device for bottom sheet feeding.

23 Claims, 3 Drawing Sheets

AUTO-DUPLEX/SIMPLEX FEEDER MODULE

This invention relates to a sheet feeding module for use in a printer, and more particularly concerns a self-contained sheet feeding module adapted to be used for both simplex and duplex copying.

In conventional printers, a sheet feed cassette is detachably installed in the main body of the printer and sheets are fed from the cassette into the printer by feed rollers mounted in the printer main body. The cassette is used for stacking and storing sheets therein with an additional function of the cassette being to support sheets outside the main body of the printer. Therefore, the feed rollers are driven through a transmission mechanism such as gears or a chain by a motor mounted within the printer main body. For duplexing, the printer requires several trays and complicated architecture which makes for complications and a wide installation and operation area. For example, most machines that are capable of duplexing have a dedicated duplex tray as well as two or three copy sheet trays which makes for larger and more costly machines. Thus, a problem is presented for reducing printers to a small, lightweight and compact size while maintaining the duplex function and reducing machine costs. The following disclosures appear relevant:

U.S. Pat. No. 4,285,607
Issued: Aug. 25, 1981
Patentee: Steinhilber
U.S. Pat. No.: 4,489,931
Issued: Dec. 25, 1984
Patentee: Costa et al.

The pertinent portions of these disclosures may be briefly summerized as follows:

Steinhilber discloses an apparatus for feeding sheets from a magazine to the printing cylinder of an office machine. The apparatus comprises an assembly unit which includes a sheet stacker, a dispenser element, a roller, and a pair of advancement rollers.

Costa et al. discloses a device for automatically positioning a sheet on a platen of an office machine. The device includes a hopper having a plate to support a stack of sheets, a stripping roller and a belt situated against the stripping roller which allows only one sheet at a time to pass through the nip between the belt and stripping roller.

In accordance with the present invention, a compact, low cost, multifunction apparatus is disclosed which makes efficient use of machine space without enlarging the machine footprint and comprises a self-contained multi-purpose sheet feeder module adapted for insertion into a printer or the like for simplex or duplex copying having a main body that includes an input opening for entry of simplexed sheets (sheets having an image on one side) and two output openings for exit of simplexed sheets for duplexing purposes and virgin sheets to receive initial images thereon. The feeder module includes a feed roll pair that feeds sheets into the feeder module with one of the feed rolls also serving as an output feed roll when feeding is from the top of sheets stacked in the feeder module. A feed means separate from the feeder module is used for feeding from the bottom of sheets stacked in the feeder module. This feeder module enables the simplification of the base machine by putting certain functions into the feeder module and thereby reducing the cost of the base machine for those customers that would not need the functions contained in the feeder module.

While the present invention will hereinafter be described in connection with a preferred embodiment thereof, it will be understood that it is not intended to limit the invention to that embodiment. On the contrary, it is intended to cover all alternatives, modifications, and equivalents that may be included within the spirit and scope of this invention as defined by the appended claims.

For a general understanding of the features of the present invention, reference is made to the drawings. In the drawings, like reference numerals have been used throughout to designate identical elements.

Figure 1:
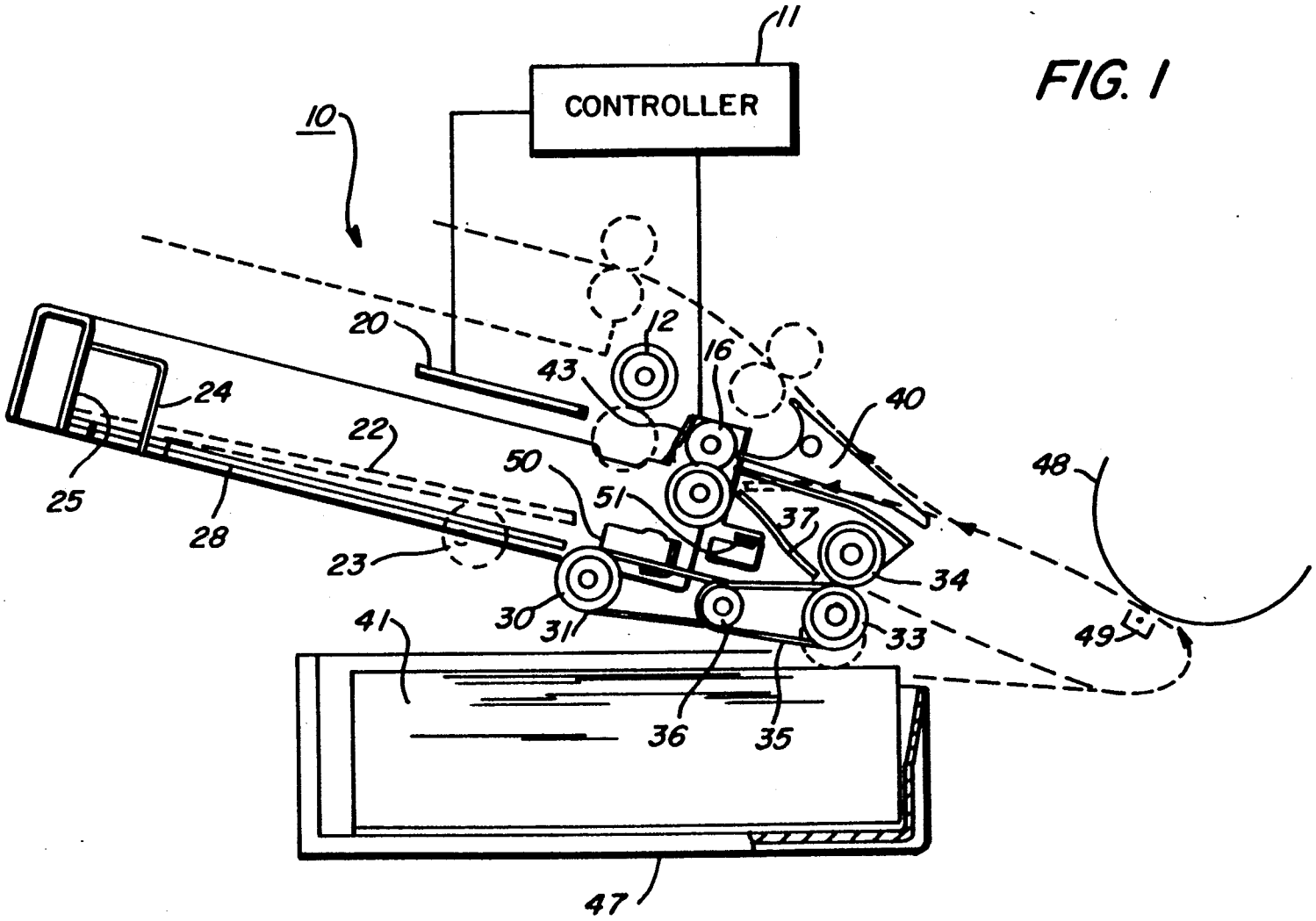
FIG. 1 is an enlarged partial schematic view of the multi-purpose sheet feeder module of the present invention in a printing environment.

Turning now to FIG. 1, self-contained multi-purpose feeder module 10 including a housing portion 13 is shown as it would appear in a printing apparatus. Insamuch as the art of electrostatographic printing is well known, the operation of the various processing stations employed in such a machine will not be discussed in detail, however, suffice it to say that an image on photoconductive member 48 is transferred to a copy sheet by transfer corotron 49. The copy sheet is then passed through a fuser and forwarded either to an output device or a duplex apparatus. The feeder module 10 is adapted for a multitude of uses. It can be used as a sheet feeder to feed virgin sheets to the photoconductive surface to have document images placed on them or it can be used as a feeder for duplex copying. In addition, the module is designed to allow sheets to be fed from the bottom of the module by a feed roll that is not enclosed within the module. For simplex copying, ordinarily a sheet is fed from the module 10 by clutch actuated and controlled feed roll 30 that rotates O-ring belts 31 which guide the sheet in forward movement. The feed roll buckles the sheet away from the stack of sheets in the tray by the use of corner snubbers 50. A normal force plate 20 insures sufficient friction between the bottom sheet in module and feed roll 30. The sheet is then forwarded onto O-ring belts 35 that are mounted around idler rolls 36 and into a driving nip formed between rolls 33 and 34. From nip 33, 34 the sheet follows the route of the arrows in FIG. 1 into engagement with photoconductive surface 48 and has an image transferred to it by transfer corotron 49. The sheet then is routed into the output tray shown in phantom lines.

Alternatively, with duplex copying as a requirement, the sheet routing process is the same as for simplex copying until the sheet leaves transfer corotron 49 where instead of being transported to an output tray, the sheet is deflected by the underside of the now actuated deflector 40 into an input opening in module 10 and a corrugation nip formed between feed rolls 14 and 16. A static eliminator 43 removes static electricity from the sheet to enhance feeding sheets out of the module and also reduces the likelihood of jams. The sheet is corrugated to enhance stacking by temporarily overcoming the effect of curl due to the curved path it has followed or by the heat applied to the sheet to fix the toner image on the sheet immediately after transfer takes place in the conventional electrostatographic process. Before the sheet reaches the corrugation nip however, controller 11 actuates cam 23 which rotates to raise false bottom 22 for receipt of the sheet. False bottom 22 is either raised or not raised depending on whether a sheet stack is to be fed 1−N or N−1 for collation purposes, i.e., if sheets are to be fed from the top of the stack the false bottom is raised and it is not raised if sheets are to be fed from the bottom of the stack. Controller 11 initiates top or bottom sheet feeding based on how the documents are placed on the photoreceptor, i.e., 1−N or N−1. After the sheet is driven into the feeder module substantially parallel to side wall 19 toward, back wall 25 by input feed rolls 14 and 16, it is driven against cantilevered member 24 shown in FIGS. 2 and 3 that includes an arm which is positioned at an acute angle with respect to the incoming sheet direction and is rotated counterclockwise by the sheet. The arm has an orthogonal depending portion that the sheet contacts. However, after the sheet ceases to be driven by the input rolls the forward force of member 24 with the assistance of gravity pushes the sheet against a front registration edge of either corner snubbers 50 or 51. While member 24 is shown as a spring, it should be understood that the spring could be replaced by a rotating taper arm, a spring assisted tapper arm or by the use of gravity only.

If top sheet feeding of the now simplexed sheet stack is required, input roll 14 will now serve as an output roll and buckles a sheet out from underneath corner snubbers 51 into a channel formed by baffle 37 and O-ring belts 35. The sheet is then captured by the drive nip 33, 34 and driven to transfer station 49 where a second image is placed on the back side of the sheet. From the transfer station the sheet is transported over the top side of deflection finger 40 and into an output tray (not shown). This process is continued for each sheet in the stack. O-ring belts 31 and 35 could be replaced with sheet metal guides if desired.

When bottom sheet feeding for duplexing is necessary, false bottom 22 stays retracted and simplexed sheets are stacked on base 28 of the feeder module and buckle fed out toward the transfer area by output feed roll 30 in cooperation with corner snubbers 50. Here also, normal force plate 20 is brought down onto the stack in order to control the feeding of single sheets reliably.

Figure 2:
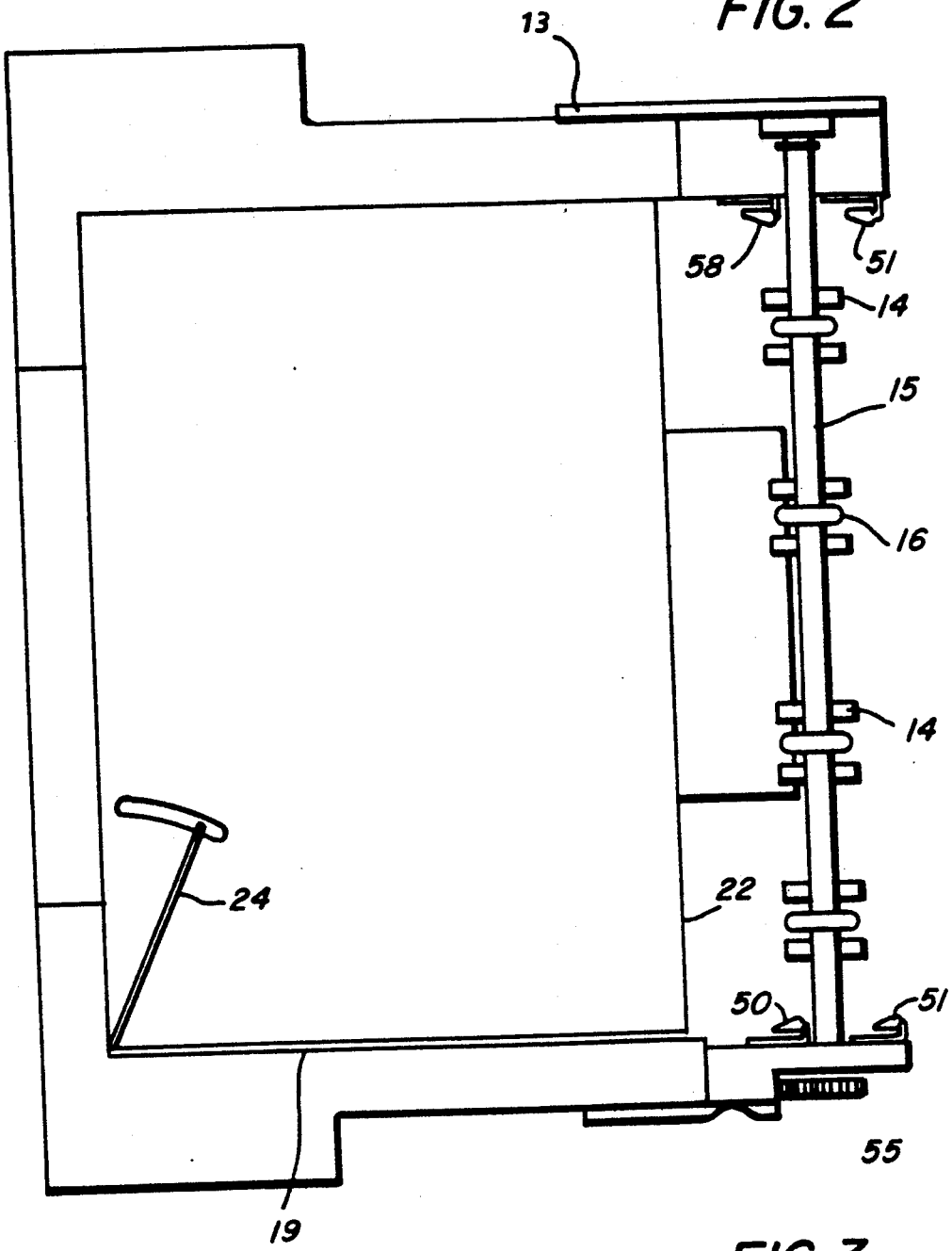
FIG. 2 is a plan view of the multi-purpose feeder module shown in FIG. 1.
Figure 3:
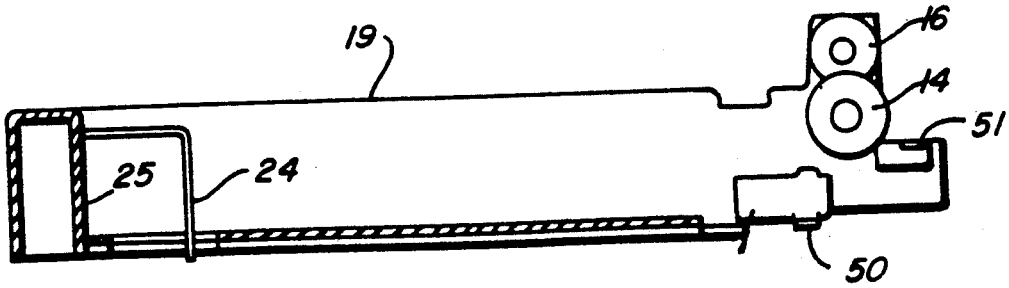
FIG. 3 is a side view of the multi-purpose feeder module of the present invention shown in FIG. 2.

Sheets from main tray 47 are fed for simplex copying and transport either into the module 10 or to an output tray by a signal from conventional controller 11 that moves dual function feed rolls 33 down onto the top of sheets 41. The feed rolls are then clutched to feed counterclockwise from the tray. Ordinarily, rolls 33 are continuously running clockwise to transport sheets to the transfer area from module 10. If the copies made on sheets fed from tray 47 are forwarded into module 10, as with sheets originally fed from module 10, the simplexed sheet can be refed either from the top or bottom of the stack. As shown in FIG. 2, a mechanical interface 55 is included with feeder module 10 for ease of connection to the printer. The module of FIGS. 2 and 3 also includes an electrical connector to supply power to the on board D.C. motors that move the false bottom and normal force plates into working positions. Interface connection of the module to the printer could be pneumatic or electrical in order to control or perform the feeding function.

Figure 4:
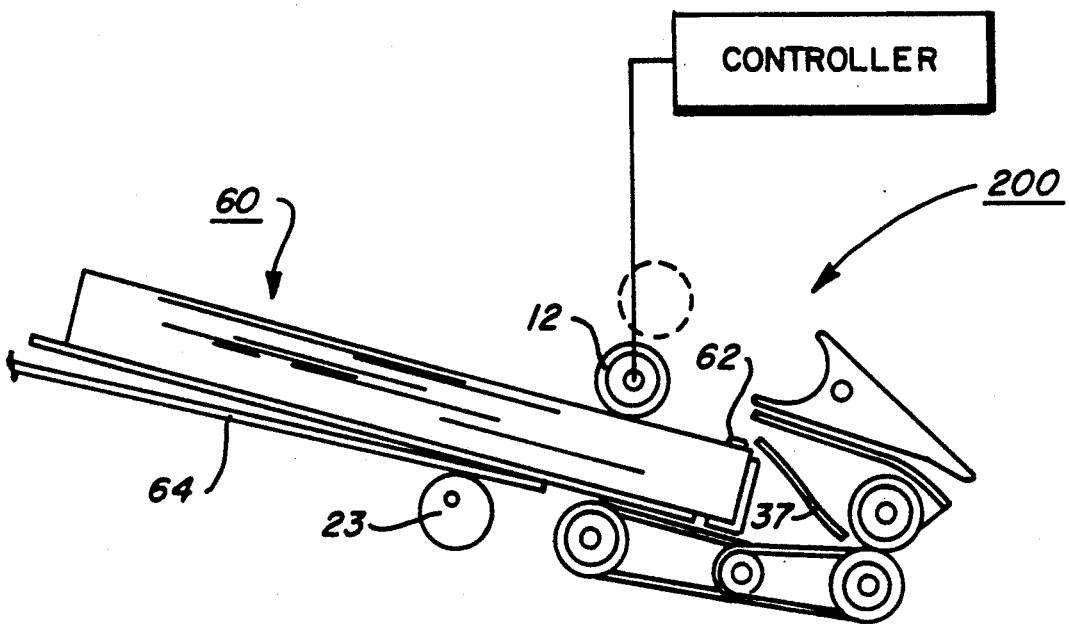
FIG. 4 is a partial side sectional view of a high capacity feeder module that is usable for simplex copying.

Universal feeder module 10 is more expensive than a standard cassette and has limited capacity. For example, ordinarly the module has a capacity of about 50 sheets for bottom feeding and 100 sheets for top feeding. Therefore, if one desired increased virgin sheet feeding capacity with less costs, an alternative feeder module 200 is shown in FIG. 4. The cassette 60 of FIG. 4 includes built in corner snubbers 62 and is adapted to hold approximately 500 sheets. A false bottom 64 is included with the cassette and controlled by controller 11 once the cassette is inserted into the printer in order to lift sheets in the cassette up against corner snubbers 62 for feeding. Clutched feed rolls 12 are used to feed sheets from the top of the cassette. When feed module 200 is in use, feed rolls 12 are pivoted by conventional means to the solid line position shown in FIG. 1 and positioned, as shown in dotted lines in FIG. 1, for feeding from cassette 60. An interlock moves feed rolls 12 out of feeding position as feeder module 200 is inserted into the printer. Cassette 60 has no interlock so rolls 12 are moved down for feeding. False bottom plate 64 could be spring biased instead of controller controlled if desired.

It should now be apparent that an automatic duplex feeder cartridge has been shown that has enhanced jam clearance, low unit cost and increased flexibility. The feed module can be used as a duplex feeder or as an auxiliary sheet feeder for feeding virgin sheets for simplex copying without duplexing. Jam clearance improvement is obtained by mounting the feed rolls in the module and in addition, storage space within the machine which would ordinarly be used for the feed rolls is available for other uses and a mechanism that would move the feed rolls when the module would be inserted or removed is eliminated. As disclosed herein, the bottom feeding feed rolls are not contained within the module, however, these rolls could be included within the module if desired. The module includes a set of upper and lower corrugation input rolls with the lower rolls serving as a top fed output rolls. An output opening is also in the module to allow bottom stack feeding depending upon requirements. A static eliminator, normal force plate, sheet registration spring and false bottom are also included within the module with the feed rolls, normal force plate and false bottom being controlled by a conventional controller once the feed module is inserted into and electrically connected to the printer.

What is claimed is:

1. A self-contained multi-purpose feeder module adapted for insertion into a printer for either top or bottom sheet feeding for simplex or duplex copying, comprising:

a housing having an input and two output openings positioned in one end portion of said housing adapted for insertion into the printer;

a first feed means positioned within said housing and including upper and lower cooperating feed rolls for driving sheets into said housing after they have been copied, and wherein said lower rolls of said feed rolls are adapted to also feed sheets out of one of said output openings of said housing when top sheet feeding is required; and second feed means for feeding sheets from said housing through the other of said output openings when bottom sheet feeding is required.

2. The feeder module of claim 1, including corner snubbers positioned within said feeder module relative to said first and second feed means such that buckle feeding of sheets is accomplished.

3. The feeder module of claim 2, including normal force means adapted for use in bottom sheet feeding from said feeder module.

4. The feeder module of claim 3, including static eliminator means positioned within said feeder module for removing static electricity from sheets entering said feeder module after they have been copied.

5. The feeder module of claim 4, wherein said first feed means includes a means for corrugating sheets coming into said feeder module in order to remove curl from the sheets.

6. The feeder module of claim 2, including false bottom means adapted to lift simplexed sheets stacked thereon into feeding engagement with said first feeding means for duplex copying.

7. The feeder module of claim 6, including means for registering sheets coming into said feeder module against said corner snubbers for refeeding out of said feeder module.

8. The feeder module of claim 6, wherein said means for registering sheets comprises a cantilevered spring having a depending arm portion thereof extending orthogonally to the sheet support surface of said feeder module, said depending arm portion of said spring being adapted to tap one side of sheets coming into said feeder module in order to register the sheets.

9. The feeder module of claim 8, wherein said second feed means is repositionable and positioned outside said feeder module and adapted to top feed sheets from another source.

10. A universal feeder module for use in a printing device for simplex or duplex copying comprising:

a housing member; and multi-mode feed means positioned within said housing member for receiving simplexed sheets from the printing device and feeding simplexed and virgin sheets to the printing device, said multi-mode feed means when in a first mode of said multi-modes feeds simplexed sheets transported by said printing device into said housing member, and when in a second mode of said multi-modes feeds the simplexed sheets out of said housing member from the top of the sheet stack in order for the simplexed sheets to be duplexed by said printing device, and when in a third mode of said multi-modes feeds the simplexed sheets from the bottom of the sheet stack for duplexing by said printing device.

11. The feeder module of claim 10, wherein said multi-mode feed means when in a fourth mode of said multi-modes feeds virgin sheets from said housing member to receive images transferred thereto by a transfer means.

12. The feeder module of claim 11, wherein said multi-mode feed means when in a fifth mode of said multi-modes feeds virgin sheets from the top of the sheet stack if one feeding selection is made and from the bottom of the sheet stack if another feeding selection is made.

13. The feeder module of claim 10, including means for selection between said second and third modes so as to provide for collated duplexed sheet output.

14. In a printer apparatus capable of generating images and including a charge retentive member to receive those images and a transfer member adapted to transfer the images from the charge retention member to copy sheets and increased sheet feeding capacity of the printer without increasing the size of the printer, the improvement comprising:

a feeder module adapted to be inserted into a predetermined volume of the printer, said feeder module including a first integral means for feeding simplexed sheets into said feeder module through a first path, second integral means for feeding the simplexed sheets out of said feeder module through a second path for receiving images on the opposite sides thereof, and a third path integral with said feeder module through which either simplexed or virgin sheets are fed toward the transfer member.

15. The improvement of claim 14, including feed means positioned outside said feeder module and adapted to bottom feed either simplexed or virgin sheets through said third path of said feeder module toward the transfer member.

16. The improvement of claim 15, including normal force means for increasing friction between the sheets in said feeder module and said feed means.

17. The improvement of claim 16, including means for corrugating sheets as they are fed into said feeder module by said first integral means in order to control the feeding of sheets reliably.

18. The improvement of claim 17, including static eliminator means for removing static electricity from sheets entering said feeder module.

19. The improvement of claim 18, including means for registering sheets in a downward direction within said feeder module.

20. The improvement of claim 14, wherein a portion of said second integral means for feeding is pivotable between a first position for feeding sheets from the bottom of said feeder module and a second position for feeding sheets from the top of a separate source.

21. A moveable and insertable duplexing cassette unit at the exterior of a printer including means for receiving and stacking simplexed copy sheets, and selectable means for feeding said copy sheets back into said printer from the top of the sheet stack when said copy sheets are fed into said cassette unit in a first orientation and from the bottom of the sheet stack when said copy sheets are fed into said cassette unit in a second orientation in order to provide properly collated duplexed copy sheet output.

22. A universal feeder module for use in a printing apparatus for producing simplexed or duplexed copy sheets, comprising:

means for receiving simplexed copy sheets into said feeder module and stacking the same from said printing apparatus, and means for feeding said copy sheets out of said feeder module from the top of said feeder module when said copy sheet are fed into said feeder module in a first orientation and from the bottom of said feeder module when said copy sheet are fed into said feeder module in a second orientation so as to provide collated duplexed output.

23. The feeder module of claim 22, wherein said module is an integral, removable and insertable cassette.

* * * * *